United States Patent [19]

Ferguson et al.

[11] Patent Number: 4,804,562

[45] Date of Patent: Feb. 14, 1989

[54] METHOD FOR REPAIRING CERAMIC CASTING CORES

[75] Inventors: T. Arnold Ferguson, Manchester; Linda L. Seaver, Bristol, both of Conn.

[73] Assignee: United Technologies Corporation, Hartford, Conn.

[21] Appl. No.: 99,273

[22] Filed: Sep. 21, 1987

[51] Int. Cl.[4] ..... B32B 35/00

[52] U.S. Cl. ..... 427/140; 427/190; 427/199; 427/299; 427/369; 427/376.2; 427/380; 427/397.7

[58] Field of Search ..... 427/140, 180, 189, 190, 427/197, 198, 199, 299, 369, 376.1, 376.2, 397.7; 156/94

[56] References Cited

U.S. PATENT DOCUMENTS

| | | | |
|---|---|---|---|
| 124,559 | 3/1872 | Elliott et al. | 264/36 |
| 3,231,401 | 1/1966 | Price et al. | 106/57 |
| 3,234,308 | 2/1966 | Herrmann | 264/63 |
| 3,281,309 | 10/1966 | Ross | 427/190 |
| 3,287,476 | 11/1966 | Snyder | 264/36 |
| 3,423,216 | 1/1969 | Somers | 106/38.35 |
| 3,704,153 | 11/1972 | Kanter | 427/199 |
| 3,957,715 | 5/1976 | Lirones et al. | 260/37 SB |
| 4,018,944 | 4/1977 | Hallstrom et al. | 427/140 |
| 4,221,748 | 9/1980 | Pasco et al. | 264/43 |
| 4,247,580 | 1/1981 | Chao | 427/140 |
| 4,351,858 | 9/1982 | Hunold et al. | 427/190 |
| 4,397,671 | 8/1983 | Vong | 427/190 |
| 4,419,162 | 12/1983 | Fischer | 156/94 |
| 4,427,742 | 1/1984 | Willgoose et al. | 428/338 |
| 4,526,636 | 7/1985 | Mader | 156/94 |
| 4,539,224 | 9/1985 | Matsuhisa | 427/190 |
| 4,568,594 | 2/1986 | Hordonneau et al. | 427/376.1 |
| 4,677,009 | 6/1987 | Virkar | 427/376.2 |

FOREIGN PATENT DOCUMENTS

| | | | |
|---|---|---|---|
| 46-110 | 1/1971 | Japan | 264/36 |

*Primary Examiner*—Sadie Childs

*Attorney, Agent, or Firm*—James M. Rashid

[57] ABSTRACT

Defects in green, unsintered ceramic casting cores which contain a thermoplastic binder are repaired according to this invention. In a preferred embodiment, a mixture of a volatilizable solvent and ceramic particles are applied to the defect. The solvent softens the binder in the core, and the loose ceramic particles patch the defect area. After the solvent volatilizes, the binder hardens and binds the newly applied particles to the core. Then, the repaired core is heated to a first temperature to volatilize the binder, and then to a second, higher temperature to sinter the ceramic particles to each other.

8 Claims, No Drawings

METHOD FOR REPAIRING CERAMIC CASTING CORES

TECHNICAL FIELD

This invention generally relates to cast metals. In particular, it relates to cores used in making metal castings. Most particularly, the invention relates to the repair of cores used in investment casting.

BACKGROUND

Ceramic cores are widely used in the casting of metal components. See, e.g., U.S. Pat. Nos. 3,957,715 to Lirones et al and 4,221,748 to Pasco et al. The cores are typically made by molding a mixture of ceramic particles and a binder into a desired shape to form a green (unsintered) core, and then heating the core to a high temperature to drive off the binder and sinter the ceramic particles to each other, as described in U.S. Pat. No. 3,234,308 to Herrmann. Ceramics which are useful in making cores include simple oxides such as aluminum oxide (alumina) and silicon dioxide (silica), as well as complex oxides such as zirconium orthosilicate (zircon), aluminum silicate (mullite), and magnesium aluminate (spinel). Core properties are often optimized by incorporating a mixture of different types (i.e., compositions) of ceramic particles in the core. The particles are usually in the form of powders, although ceramic fibers can also be used to make cores, as described in U.S. Pat. No. 4,427,742 to Wilgoose et al and in commonly assigned pending U.S. patent application Ser. No. 018,113 to Roth. This patent application and the issued patents noted above are all incorporated by reference. Injection molding and transfer molding are two techniques which are widely used in the manufacture of cores.

Green cores are occasionally produced which have defects of one sort or another such as cracks or pits, and in many instances, it is more economical to discard such defective cores rather than to repair them. However, in some cases, core manufacturers would rather repair the cores. This invention relates to an economical method for repairing defective green cores.

SUMMARY OF THE INVENTION

This invention relates generally to the fabrication of defect free casting cores, and more specifically, to the repair of defects in green cores which contain ceramic particles and a thermoplastic binder. It is particularly useful for the repair of surface connected defects in green ceramic casting cores used in the investment casting industry. The invention includes the steps of (a) softening the thermoplastic binder in the core; (b) while the binder is soft, applying loose ceramic particles to the defect, the particles having a composition similar to the overall composition of the core; (c) allowing the binder to reharden; and (d) heating the core to volatilize the binder and sinter the ceramic particles to each other.

The term "thermoplastic binder" is used in the conventional sense, and intended to describe natural as well as synthetic polymeric materials which are solid at room temperature and are capable of repeated softening at elevated temperatures. Thermoplastic materials may also be softened when contacted by various types of chemical solvents. The ability of thermoplastic binders to become moldable by the application of heat and softened by the application of chemical solvents makes them particularly useful in the fabrication of casting cores made of ceramic materials, and the repair of such cores according to this invention.

In a preferred embodiment of the invention, surface connected defects in green investment casting coresare repaired by simultaneously applying onto the surface of the core, in the area of the defect, a mixture of ceramic particles and a liquid solvent capable of softening the binder present in the core. The ceramic particles in the solvent-particle mixture have the same composition and are in the same ratio as the ceramic particles in the core itself. While the solvent reacts with and softens the binder, the ceramic particles applied to the defect and some of the binder mix with each other, apparently as a result of diffusion or capillary type action; when the solvent is removed (e.g., by volatilization at room temperature) the binder hardens and binds the newly added ceramic particles to the core. The core is then heated to a relatively low temperature to volatilize the binder and any remaining solvent, and then to a much higher temperature to sinter the ceramic particles in the core to each other.

Defects in the core which can be repaired according to this invention include surface connected cracks and pits. After sintering, the repaired cores have properties which are comparable to cores which were initially defect free.

Other features and advantages of this invention will become more apparent in light of the following description which includes a description of the preferred embodiment of the invention.

BEST MODE FOR CARRYING OUT THE INVENTION

As noted in the Background section, several types of cores are used in the investment casting industry, and specialized techniques are used for making them. This invention specifically relates to cores which utilize thermoplastic binders to bind the ceramic particles (the term "ceramic particles" is meant to describe ceramic powders as well as ceramic fibers) to each other in the green state, i.e., before the core is sintered. The methods described below allow surface connected defects in such green cores to be easily repaired.

This invention is particularly useful in repairing cores having a complex geometry, such as those used in the investment casting of gas turbine engine components, e.g., hollow, air cooled blades and vanes used in the turbine section of the engine. See the aforementioned patent application to Roth.

Green cores made in accordance with this invention comprise a substantially uniform mixture of two major constituents: ceramic particles and thermoplastic binder. During the process of fabricating the core, a mixture of ceramic particles and binder is heated and injection molded into a die having a cavity which corresponds to the desired shape of the core. The temperature of the molding process is high enough to soften the binder, causing it to flow under pressure and become uniformly distributed among the ceramic particles. As the core cools, the binder hardens, causing the ceramic particles to adhere to each other.

The presence of thermoplastic binders in the core is the key feature which permits the repair of surface connected defects in the core. Thermoplastic binders can be readily softened by the application of heat or by contact with an appropriate chemical solvent. When the softening agent (heat or solvent) is applied locally to the core, in the area of the defect, the binder becomes locally softened both at and below the surface of the core. While the binder is softened, a repair mixture of ceramic particles is applied to "patch" the defect. When the binder hardens (after the softening agent is removed), the repair mixture is adhered to the core body, which suggests that some of the softened binder diffuses into or is drawn by capillary type action into the repair mixture. After the core is adequately patched, it is heated to a first temperature to volatilize the binder, and then heated to a second, higher temperature to sinter the ceramic particles to each other.

Tests have shown that the binder must be softened and additional ceramic particles must be added to the core to obtain satisfactory repair results. If additional particles are added to the defect without any softening of the binder, the added particles tend to sinter only to themselves and not to the existing ceramic in the core when heated. As a result, the properties of the core in the repair area are poor and the core will not be useful. Likewise, if the binder is softened but no additional ceramic particles are applied to the defect, the repair effort will be ineffective.

The invention is applicable to all core systems which utilize thermoplastic binders. One ceramic composition range (by weight percent) for cores which utilize thermoplastic binders is as follows: 10–50 zircon, 1–20 alumina, balance silica. Typically, the binder in such cores is present in amounts which range from between about 10 to 20% (as a percentage of total ceramic weight). The specific method used to soften the binder will depend upon the specific type of binder used to make the core. While heat will cause thermoplastic binders to soften, the use of volatilizable solvents is preferred, because they are easier to apply to the core. Whatever softening agent is used, it should not cause the binder to decompose or to volatilize, and it should not cause the core to distort or to otherwise change its size or shape. The softening agent is preferably applied only to the area of the defect, i.e., to the surface of the defect itself and to the surface of the core adjacent to the defect.

Defects which may be repaired according to this invention include cracks and surface depressions such as pits or cavities. The defect should be present on, or at least connected to, the surface of the core. However, it should be noted that not all surface connected defects are suited for repair according to this invention. Certain types of defects may require the use of specialized equipment to fixture the core and maintain its geometry during the repair process. In view of the expenditure of time required to complete the repair of such a core, it may be preferable to simply discard such cores and produce new ones. Determining whether or not the core should be repaired requires that consideration be given to the configuration of the core, especially in the area of the defect.

When organic solvents (such as toluene, benzene, or hexane) or halogenated solvents (such as trichloroethane or methylene chloride) are used to soften the binder in the green core, the solvent is applied directly to the defect, and to the area adjacent to the defect. Once the binder has softened, ceramic particles are applied to repair the defect. Preferably, the solvent and particles are applied simultaneously to the defect, for example, by brushing a mixture of the solvent and ceramic particles onto the defect. The best results are obtained when the defect is slightly overfilled with the repair mixture. After sintering, material protruding above the nominal core surface is removed, so that the surface of the core is smooth.

The size and shape of the defect will generally determine the amount of particles which should be present in the solvent-ceramic mixture. When repairing wide cracks or deep depressions in the core, more particles per unit volume of solvent may be useful than when repairing narrow cracks or shallow depressions. Also, wide and/or deep defects may require that the repair mixture be applied in several steps, allowing the solvent to at least partially volatilize between subsequent steps.

After the core has been heated to sinter the ceramic particles to each other, the core is inspected. Visual or radiographic techniques are among those which can be utilized. In many cases, visual inspection will be adequate, and the success of the repair will be readily apparent.

The invention may be better understood by reference to the following example, which is meant to illustrate the features of the invention and not limit its scope. A green ceramic casting core containing ceramic particles and a thermoplastic binder was prepared by injection molding, using techniques known to those skilled in the art. The core had a shape suitable for forming the internal passages of an air cooled blade used in the high temperature section of a gas turbine engine. The core was made up of about 28% zirconium orthosilicate, 3% aluminum oxide, balance silicon dioxide. The zirconium orthosilicate and silicon dioxide particles were generally −325 mesh (U.S. Sieve Series) powder particles; the aluminum oxide particles were in the form of high aspect ratio fibers. The binder constituents were primarily paraffin and ceresin wax and were present in an amount which corresponded to about 14% of the total weight of the ceramic mixture. Small amounts of aluminum stearate and oleic acid were present in the core mixture, to aid in the injection molding process. Visual inspection of the green core after molding revealed cracks in the trailing edge area. The cracks were repaired in the following manner:

a blend of the ceramic constituents, in the same proportion as present in the core, were added to 1-1-1 trichloroethane. The ceramic-solvent mixture was brushed into the crack until the crack was slightly overfilled with the ceramic particles. After the majority of the trichloroethane volatilized, and the binder hardened, the core was slowly heated in an air atmosphere to about 540° C. (1,000° F.) to volatilize the binder, and then, to about 1,230° C. (2,250° F.) to sinter the ceramic particles to each other. The temperature of the furnace was then reduced back to room temperature, and the core removed. Visual inspection revealed that the crack had been fully repaired, with no evidence of any prior defect. The repaired area was polished to smooth its surface, and the core was then ready for use.

Although this invention has been shown and described with respect to a preferred embodiment, it will be understood by those skilled in the art that various changes in form and detail thereof may be made without departing from the spirit and scope of the claimed invention.

We claim:

1. A method for repairing a defect in a green ceramic casting core containing ceramic particles and a thermoplastic binder, comprising the steps of: softening the binder in the area of the defect; applying ceramic particles to the defect while the binder is soft; hardening the binder; and heating the core to volatilize the binder and to sinter the ceramic particles to each other.

2. The method of claim 1, comprising the step of softening the binder by applying a liquid solvent to the defect.

3. A method for repairing a surface connected defect in a green casting core which contains ceramic particles and a thermoplastic binder, comprising the steps of: applying a mixture of a volatilizable liquid solvent and ceramic particles to the area of the defect, wherein the solvent softens the binder in the defect area; volatilizing the solvent to harden the binder in the area of the defect; and heating the core to volatilize the binder and to sinter the ceramic particles to each other.

4. The method of claim 3, wherein the ceramic particles are selected from the group of zirconium orthosilicate, aluminum oxide, and silicon dioxide, and wherein the thermoplastic binder is essentially wax.

5. A method for repairing a surface connected defect in a green casting core which contains a mixture of at least two different types of ceramic particles and about 10–20 weight percent thermoplastic wax binder, comprising the steps of applying a repair mixture of ceramic particles and a volatilizable solvent to the defect, wherein the solvent softens the wax binder and the ceramic particles fill in the defect; volatilizing the solvent to cause the binder to harden; heating the core to sinter he ceramic particles to each other; and smoothing the surface of the core in the area of the repair mixture.

6. The method of claim 5, wherein the core is in the shape of an internal cavity of a gas turbine engine blade or vane.

7. A method for reparing a defect in a ceramic casting core containing ceramic particles by applying additional ceramci particles to the defect and then heating the component to sinter the particles to each other, the improvement which comprises applying a solvent to the area of the defect, wherein the ceramic particles in the component are adhered to each other by a thermoplastic binder and said solvent softens the binder; applying said additional ceramic particles to the component; allowing the binder to harden; and then heating the component to volatilize the solvent and sinter the particles to each other.

8. The method of claim 7, wherein the solvent and additional ceramic particles are applied simultaneously.

* * * * *